US008024883B1

(12) United States Patent
Boord

(10) Patent No.: US 8,024,883 B1
(45) Date of Patent: Sep. 27, 2011

(54) FIREARM SUPPORT

(76) Inventor: Richard Nils Boord, Smithton, PA (US)

( * ) Notice: Subject to any disclaimer, the term of this patent is extended or adjusted under 35 U.S.C. 154(b) by 503 days.

(21) Appl. No.: 11/903,872

(22) Filed: Sep. 25, 2007

(51) Int. Cl.
*F41C 27/00* (2006.01)

(52) U.S. Cl. ..... 42/94; 42/90

(58) Field of Classification Search ..... 42/94
See application file for complete search history.

(56) References Cited

U.S. PATENT DOCUMENTS

| | | | | |
|---|---|---|---|---|
| 4,903,425 | A * | 2/1990 | Harris | 42/94 |
| 5,029,407 | A * | 7/1991 | Kirkpatrick | 42/94 |
| 5,194,678 | A * | 3/1993 | Kramer | 42/94 |
| 5,345,706 | A * | 9/1994 | Brown | 42/94 |
| 5,711,103 | A * | 1/1998 | Keng | 42/94 |
| 5,903,995 | A * | 5/1999 | Brubach | 42/94 |
| 5,937,560 | A * | 8/1999 | Beltz | 42/94 |
| 6,931,777 | B1 * | 8/2005 | Krien | 42/94 |
| 7,571,563 | B2 * | 8/2009 | Peterson | 42/94 |
| 2007/0094911 | A1 * | 5/2007 | Rush et al. | 42/85 |
| 2007/0261287 | A1 * | 11/2007 | Hunt et al. | 42/94 |
| 2009/0126250 | A1 * | 5/2009 | Keng | 42/94 |
| 2009/0249674 | A1 * | 10/2009 | Boord | 42/94 |

* cited by examiner

*Primary Examiner* — Michael Carone
*Assistant Examiner* — Samir Abdosh
(74) *Attorney, Agent, or Firm* — Carothers & Carothers

(57) ABSTRACT

A firearm support for a firearm having an elongate sling extending along the firearm with two opposite ends attached in spaced relationship to the firearm between a stock end and a barrel end. The firearm support includes a support attachment in the form of clamp which may be secured to the sling at a desired position therealong. At least one support leg is pivotally secured to the support attachment and depends from the attachment whereby the leg may be pivoted from a storage position with the at least one leg extending along in alignment with the sling, to a deployed position at an angle relative to the sling for engaging a ground surface with a distal end of the at least one leg. The attachment for the shooting support is also provided with a forearm rest surface positioned on the side of the sling that faces the firearm for supporting the firearm thereon when the leg or legs are deployed. The attachment is rigidly secured at substantially a right angle relative to the leg or legs in the direction of the pivotal axis to prevent the support for the firearm from wobbling or canting left and right relative to the support leg or legs. The leg supports may be provided in replaceable and substitutable sets whereby the interchangeable leg sets may include one leg, a pair of legs or more.

9 Claims, 5 Drawing Sheets

FIREARM SUPPORT

BACKGROUND OF THE INVENTION

The present invention relates to firearm supports, and more particularly, firearm supports commonly referred to as shooting sticks for use to steady a firearm for accurate shooting.

Rifle or firearm supports have been in existence since the advent of firearms for improving firing accuracy. Such supports, sometimes referred to as shooting sticks, are in the form of a mono-pod, a bi-pod or tripod leg configuration. They are either directly attached to the rifle, as disclosed for example in U.S. Pat. No. 5,345,706, or they can be independent support devices on which the rifle is rested. US Patent Application Publication No. 2007/0094911, discloses a rifle support which is attached to the rifle sling as opposed to being attached directly to the rifle. The advantage of this latter configuration is that the collapsible legs in a stored position may be oriented along the sling. In this latter disclosure, the collapsible leg or legs have an elastic member extending through the tubular legs so that the elastic member resiliently biases the leg to automatically deploy to a fully extended position when released from its containment to the rifle sling. However, a problem encountered in this particular arrangement is that the deployment of the leg or legs is extremely noisy and can thereby readily scare off game within hearing distance.

It is an objective of the present invention to provide and improve the shooting support for a firearm which is easily carried and deployed, and which can be readily and quickly secured to any firearm or rifle without special adaptation.

SUMMARY OF THE INVENTION

The firearm support of the present invention is provided for attachment to a firearm, such as a rifle, having an elongate sling extending along the firearm with two opposite ends of the sling attached in spaced relationship to the firearm between the firearm stock and the barrel end of the firearm. The firearm support of the present invention is comprised of a shooting support attachment which is removably securable to the firearm sling at any desired position therealong so that the attachment may be made to most any conventional sling without the requirement of any additional securements. One or multiple support legs are pivotally secured at a pivotal axis, which is transverse to the direction of extension of the leg or legs, to the support attachment. The leg or legs depend from this attachment whereby the leg or multiple legs may be pivoted from a storage position against or alongside the sling, and deployed from this storage position to an angle relative to the sling for engaging a ground surface with the distal end of the leg or legs.

The shooting support attachment is provided with a forearm rest surface positioned on the side thereof facing to the firearm for adequately supporting and cradling the firearm thereon when the leg or multiple legs are deployed. The support attachment is rigidly secured at substantially a right angle relative to the leg or legs in the direction of the pivotal axis so that the support attachment, and the rifle resting thereon, will be prevented from cantering right or left once supported on the leg or legs.

A single collapsible leg, such as telescopically collapsible, may be employed, or multiple legs, for example a pair of legs, may be used. When a pair of legs are incorporated into the structure, the pivotal connection of each leg to the attachment is angled whereby the legs are in parallel to each other when in the storage position, yet are splayed when in the deployed position.

The firearm support attachment is provided in the form of a clamp which can be transversely clamped to the conventional sling at any desired position therealong. Accordingly, no special structure is required for attachment to the sling or to the rifle.

A separate strap may be also provided for temporarily securing the firearm down against the firearm rest surface of the attachment so that the firearm and the deployed legs will be retained in engaged combination even when the rifle is moved.

Another alternative feature of the present invention is that the single leg or multiple leg sets are interchangeably attachable to the shooting support attachment so that a single leg set or a multiple leg set may be readily interchanged.

A swivel connection is also preferably provided between the selected leg set and the shooting support attachment which permits rotation of the attachment on the leg set in a plane which is transverse to the downward extension of the legs when deployed to permit swinging of the firearm as it rests on the attachment with ease in a horizontal plane for sighting.

The single leg set or multiple leg set may also be configured whereby when they are released from their storage position along side the sling they will readily move of their own accord from the horizontal to the deployed position by gravity. If desired, an accessory strap may also be secured to the sling which can be wrapped around the leg or legs to temporarily secure them to the sling in the stored position. For example, this may be accomplished with a strap utilizing common hook and loop fasteners.

BRIEF DESCRIPTION OF THE DRAWINGS

Other objects and advantages appear hereinafter in the following description and claims. The accompanying drawings show, for the purpose of exemplification, without limiting the scope of the invention or appended claims, certain practical embodiments of the present invention wherein:

DETAILED DESCRIPTION OF THE PREFERRED EMBODIMENTS

Figure 1:
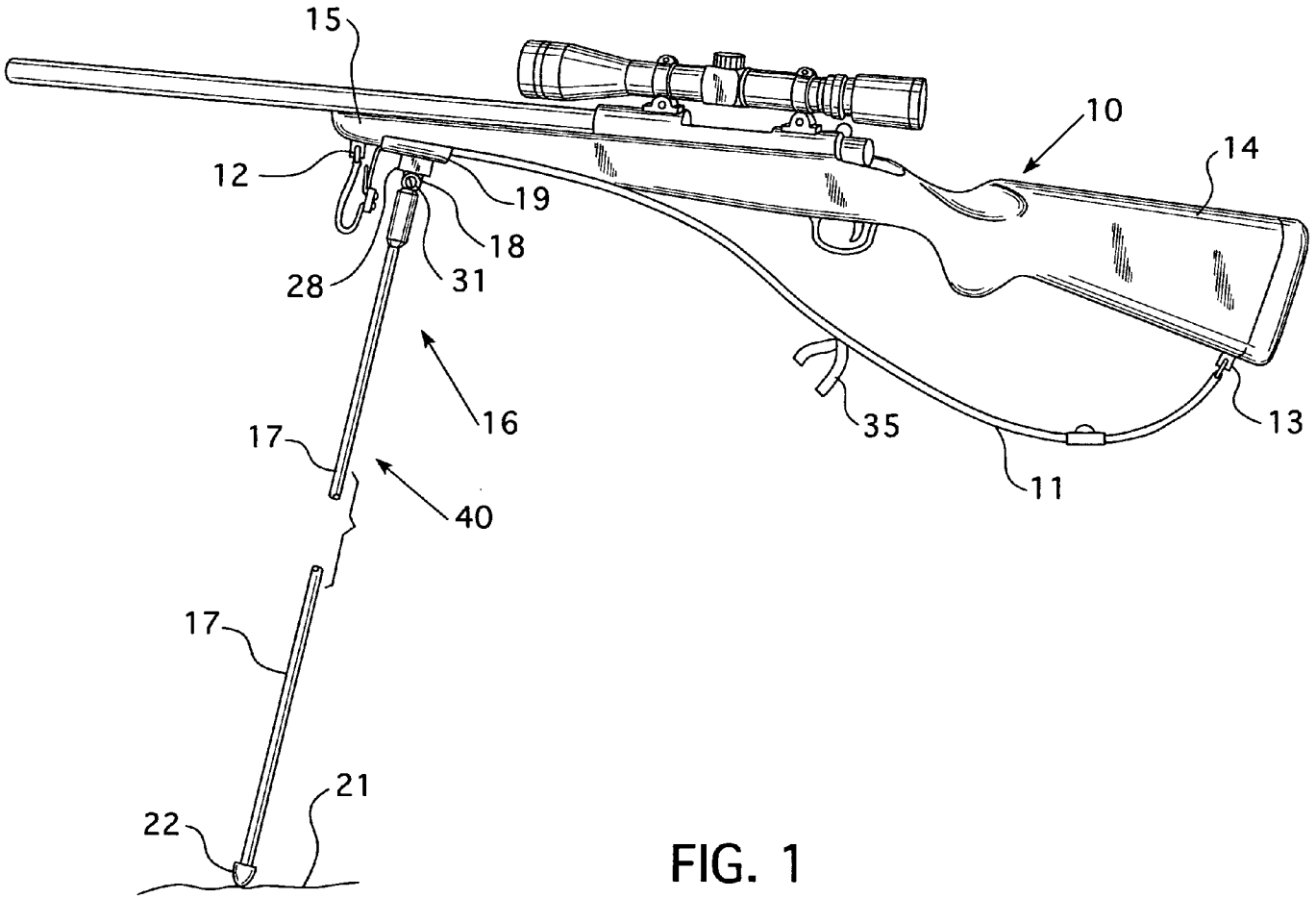
FIG. 1 is a view in side elevation of the firearm support of the present invention as secured to the sling of a conventional rifle, and having a single leg shown in the deployed position and supporting the rifle in accordance with one embodiment of the present invention.
Figure 2:
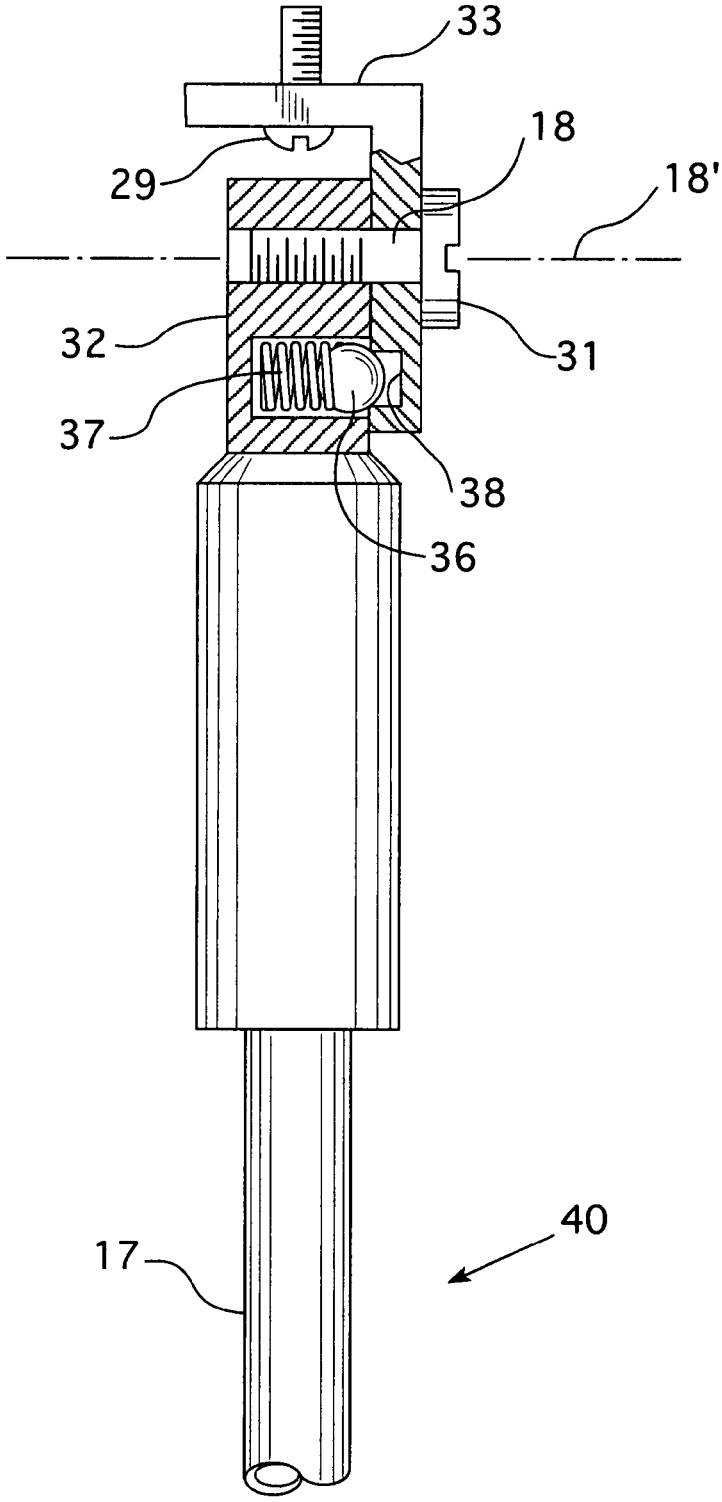
FIG. 2 is an enlarged right side rear view of the upper end of the single leg support structure shown in FIG. 1 with portions thereof sectioned away to illustrate the interior workings.

Referring first to the embodiment of FIGS. 1 and 2, a conventional firearm in the form of rifle 10 is provided with a conventional elongated sling 11 which has two opposite ends 12 and 13 attached in spaced relationship to the firearm 10 between a stock end 14 and a barrel end 15. The firearm 10 is shown as being supported on firearm support 16 of the present invention for sighting and shooting the rifle 10. In this embodiment, the support 16 is shown in the form of a single pod or leg 17 which is telescopically collapsible in two or three segments as desired. The leg 17 of firearm support 16 is pivotally secured at pivotal axis 18 to shooting support attachment 19 which is removably securable to sling 11 at a desired position therealong. Leg 17 depends from attachment 19 whereby it may be pivoted from a storage position with the leg 17 extending along and substantially in alignment with the sling 11, similar to the dual pod arrangement illustrated in FIG. 4, to the deployed position illustrated in FIG. 1 wherein the leg 17 is at an angle relative to the sling 11 for engaging a ground surface 21 with the distal end 22 of leg 17.

Figure 3:
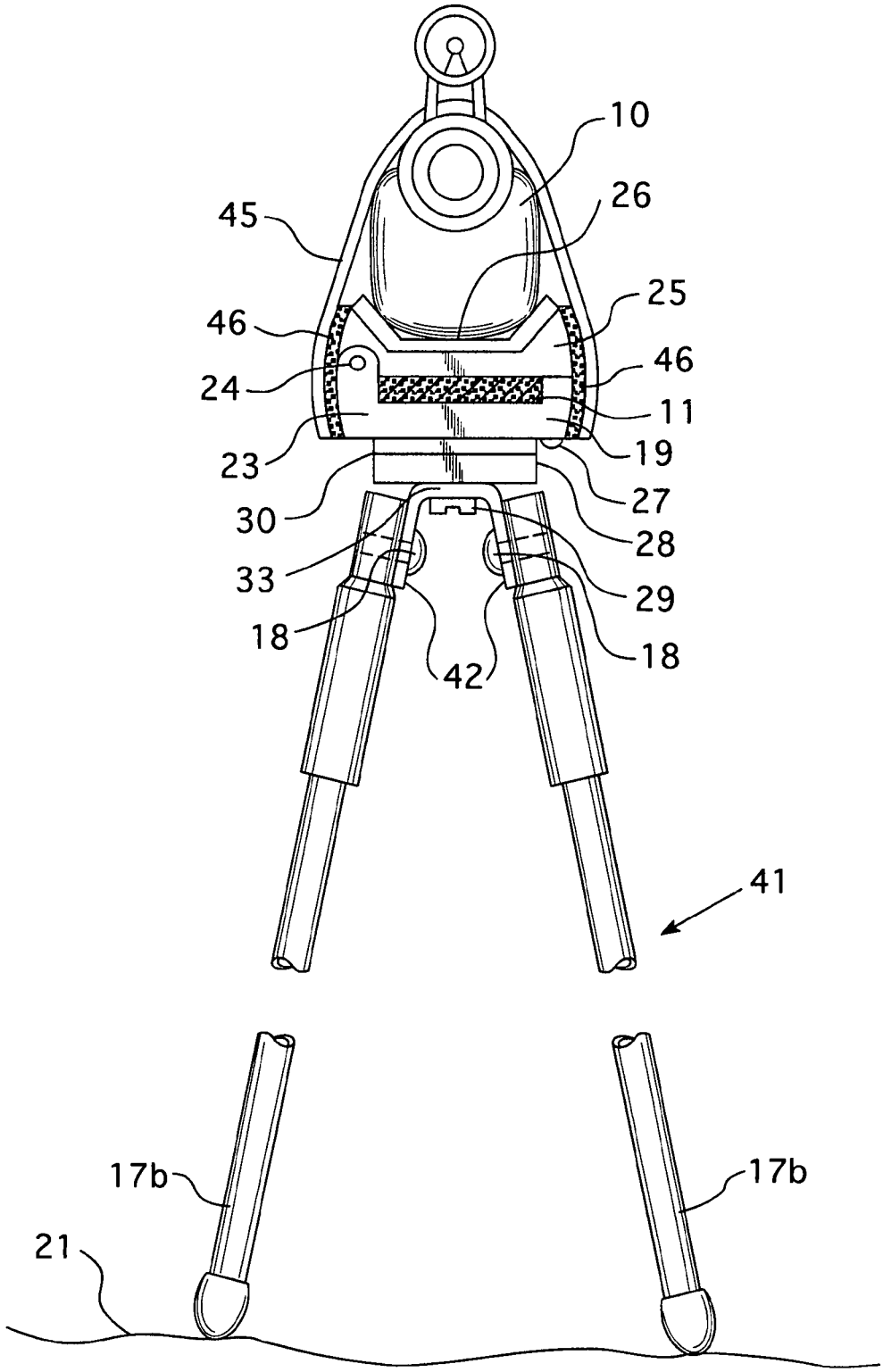
FIG. 3 is a view in front elevation of a rifle being supported on the firearm support of the present invention illustrating a second embodiment of the support wherein the support includes a pair of support legs instead of a single leg as shown in the embodiment of FIG. 1.
Figure 4:
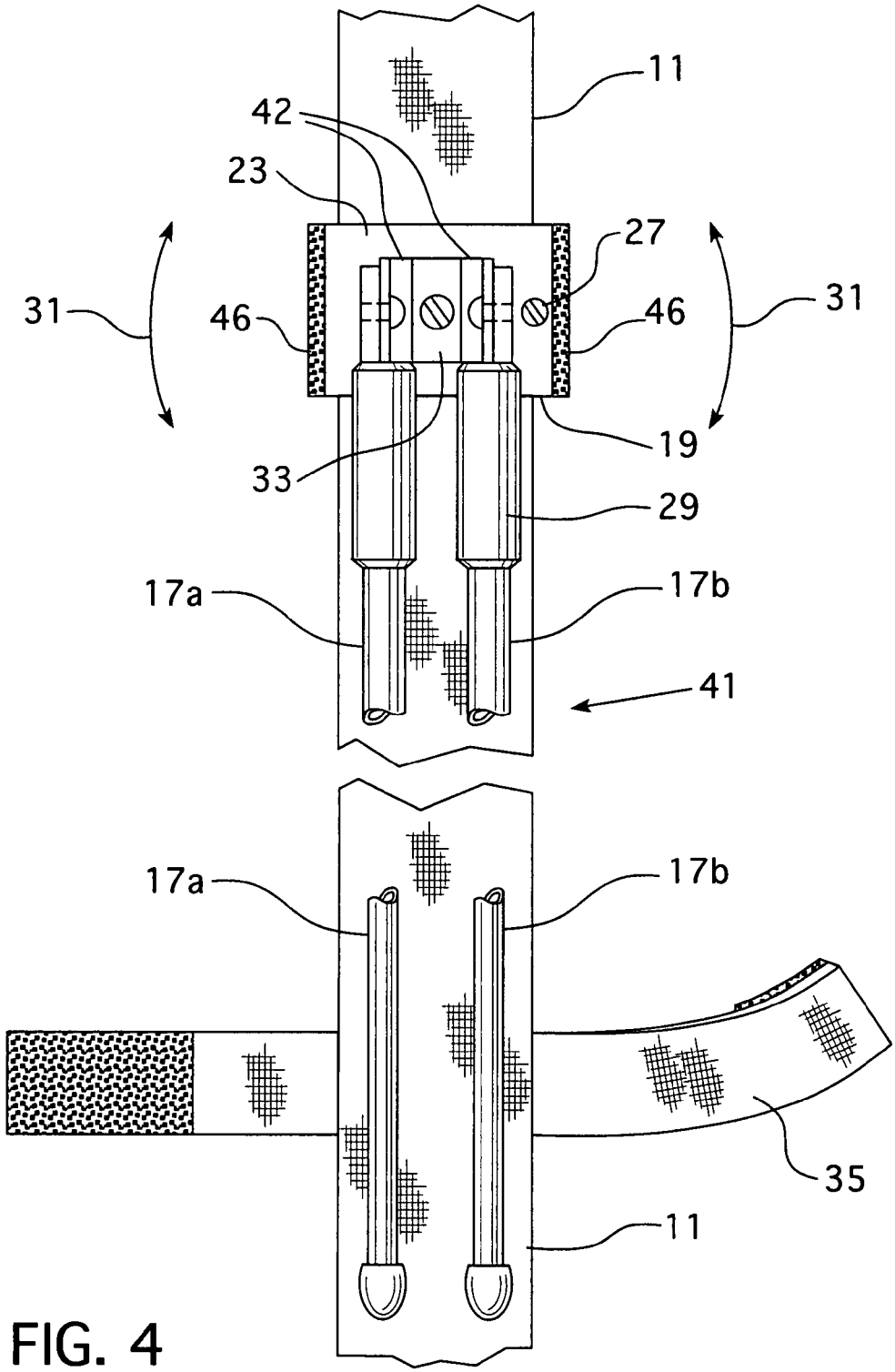
FIG. 4 is a bottom view of the support structure of the present invention as secured to the sling of the rifle shown in FIG. 3, but without inclusion of the rifle itself for the purpose of clarity, in its stored position oriented along the rifle sling.

Shooting support attachment 19 as shown in FIGS. 1 and 2 is identical in structure to that illustrated in more detail in FIGS. 3 and 4. The support attachment 19 is provided in the form of a clamp having a lower clamp portion 23 hingedly connected at 24 to upper clamp portion 25. Attachment 19 is further provided with a forearm rest surface 26 positioned on the side of the sling 11 facing to firearm 10 as illustrated in FIG. 3 for supporting the firearm 10 thereon when leg 17 is deployed as shown in FIG. 1. The forearm rest surface 25 is preferably made of an elastic material, such as rubber, in order to protect the firearm 10 and to provide good non-slip contact between the firearm 10 and the attachment 19.

The lower and upper clamp portions 23 and 25 of attachment 19 are clamped together and retained together by means of machine screw 27. In addition, attachment 19 is further provided with a base plate 28 which is secured to the leg set by machine screw 29. A slip washer 30 is a low friction washer made of a material, such as Teflon, and permits rotation of the attachment 19 on top of plate 28 in the horizontal plane as indicated by the arrows 31 in FIG. 4. It should be noted that while attachment 19 permits the firearm 10 to be rotated in a horizontal plane, nevertheless, attachment 19 is rigidly secured at substantially a right angle relative to the leg set in the direction of the pivotal axis 18' of pivot 18. This prevents canting of the rifle to the left or right.

Referring more specifically to FIG. 2, leg 17 is permitted to pivot about axis 18' on pivot 18 provided by the machine screw 31 which pivotally secures head 32 of leg 17 to leg bracket 33. Leg bracket 33 is in turn secured to base plate 28 as indicated in FIGS. 1 and 3. Leg 17 may be deployed from a stored horizontal position along side the bottom of sling 11 to the deployed position illustrated in FIG. 1 by gravity. The leg 17 when fully collapsed may be retained in the stored position along side sling 11 by securing strap 35 around leg 17. Strap 35 may be secured in any conventional manner, such as by a hook and loop fastener.

When leg 17 drops downwardly to its deployed position as shown in FIG. 1, it automatically locks in place by means of detent ball 36 which is continually urged by compression spring 37 toward leg bracket 33, such that when the leg 17 is fully deployed, detent ball 36 will protrude into detent 38 provided in leg support 33 to maintain the leg 17 in its fully deployed position. When it is desired to once again fold leg 17 back to a horizontal position from the vertical position shown in FIG. 1, this is accomplished by simple hand manipulation which will cause detent ball 36 to ride out of detent 38 and thereafter slide along the inside surface of leg support 33. When the leg 17 is secured in its stored position, which is best illustrated in FIG. 4, the firearm support 16 lies against sling 11 and is thus conveniently stored whereby when the hunter or shooter has the firearm 10 on the sling and positioned over his or her shoulder, the leg set is out of the way and depends downwardly from its attachment 19.

Referring again to FIGS. 1 through 4, the leg set 40 in FIGS. 1 and 2 is a single leg set, whereas the leg set 41 of FIGS. 3 and 4 is a dual pod or leg set. In this latter dual arrangement, the leg bracket 33 has its downwardly depending ears 42 set at an angle whereby the fully deployed legs 17*a* and 17*b* shown in FIG. 3 are splayed. However, when the legs 17*a* and 17*b* are in the fully stored position as shown in FIG. 4, the legs are in parallel to each other for alignment with sling 11, where they may be secured with strap 35.

Single leg set 40 of FIGS. 1 and 2 is fully interchangeable with the dual leg set 41 of FIGS. 3 and 4 simply by detaching and attaching the respective leg bracket 33 of one leg set for the other leg set with machine screw 29 to base 28.

As is illustrated in FIG. 3, the firearm 10 is firmly secured against the firearm rest surface 26 of support 19 by means of a removable strap 45 which extends over the forearm and barrel of firearm 10 and is securely attached to the sides of support 19 by means of the hook and loop fastening material provided at 46.

Figure 5:
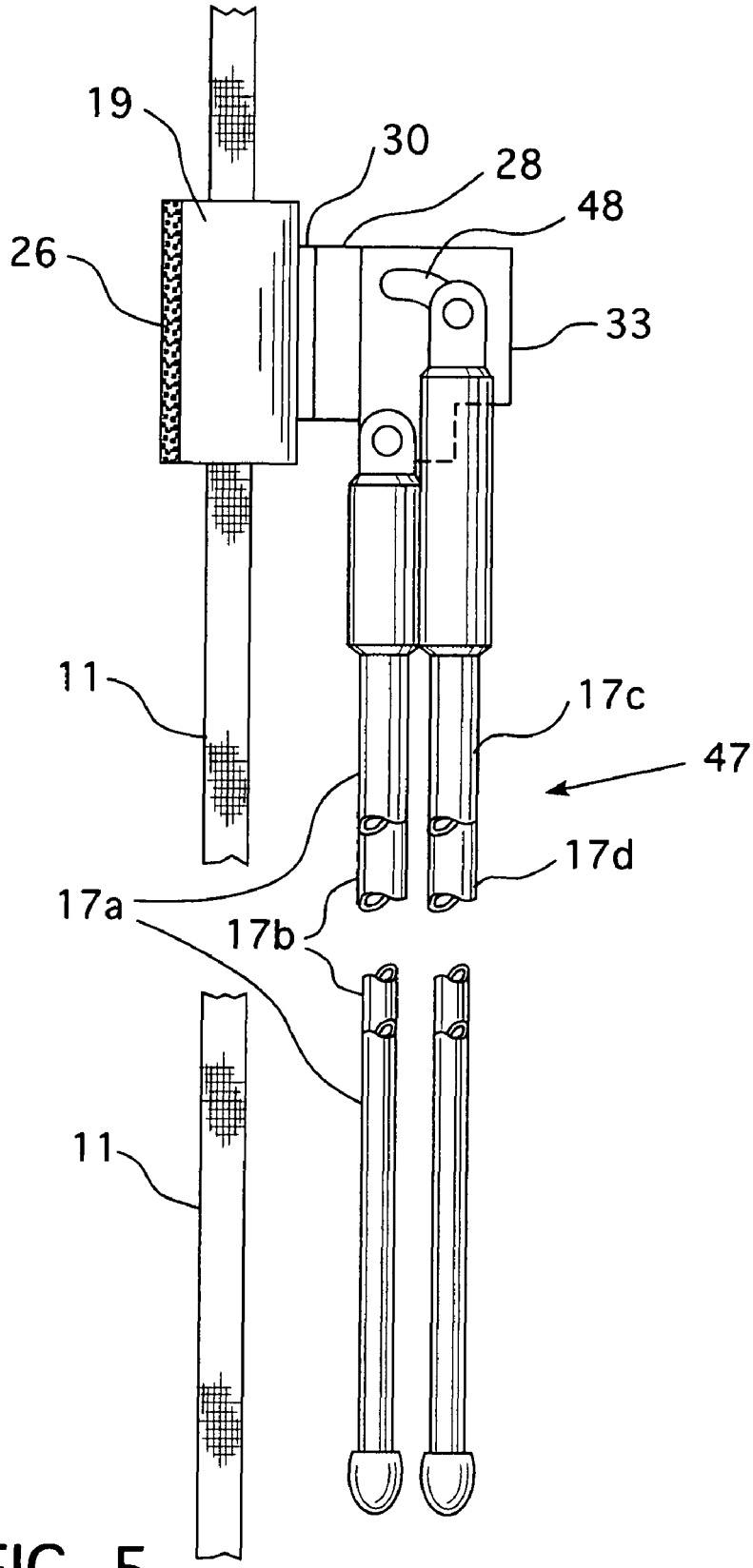
FIG. 5 is a view in side elevation of yet another embodiment of the firearm support of the present invention as secured to the sling of a rifle and disclosing a leg support set including four legs.

FIG. 5 illustrates yet another embodiment wherein the leg set 47 is provided with four legs 17*a*, 17*b*, 17*c* and 17*d*, in the form of a duplication of a leg pair from the leg set 41 shown in FIGS. 3 and 4. In all respects the embodiment of FIG. 5 operates identical to that of the leg set in FIGS. 3 and 4, except the outer leg set pair 17*c*, 17*d*, is hinged to the leg bracket 33 in the curved slot 48. This permits both pairs of inner and outer leg sets to lie snugly against each other in the stored position shown in FIG. 5, yet be spaced from each other when fully deployed.

I claim:

1. A firearm support for a firearm having an elongate sling extending along the firearm with two opposite ends attached in spaced relationship to the firearm between a stock end and a barrel end of the firearm, the support comprising:

a rigid shooting support comprised of a rigid clamp attachment which transversely clamps to exterior surfaces of said sling with clamp jaws of a rigid non-flexible material;

wherein the rigid clamp attachment is removably and selectively secured to and around said sling at different desired positions therealong without penetrating said sling;

at least one support leg pivotally secured at a pivotal axis, which is transverse to the direction of extension of said sling to and depending from said attachment whereby said at least one leg may be pivoted from a storage position with said at least one leg extending along and substantially in alignment with said sling and to a deployed position at an angle relative to said sling for engaging a ground surface with a distal end of said at least one leg;

said attachment having a forearm rest surface positioned on a side of said sling facing to said firearm for supporting said firearm thereon when said at least one leg is deployed; and said attachment rigidly secured at substantially a right angle relative to said at least one leg in the direction of said pivotal axis.

2. The firearm support of claim 1, said at least one leg including a pair of legs and the pivotal connection of said legs to said attachment angled whereby said legs are in parallel to each other in said storage position and are splayed in said deployed position.

3. The firearm support of claim 1, wherein said at least one leg is telescopically extendable.

4. The firearm support of claim 1, including a strap for temporarily securing said firearm against said forearm rest surface of said attachment.

5. The firearm support of claim 1, wherein said at least one leg is provided in the form multiple sets of legs with each set including a different number of legs, said leg sets being interchangeably attachable to said attachment.

6. The firearm support of claim 1, including a swivel connection between said at least one leg and said attachment which permits rotation of said attachment on said at least one leg in a plane transverse to said at least one leg when deployed.

7. The firearm support of claim 1, wherein said pivotal connection of said at least one leg to said attachment is configured whereby said at least one leg will move from said storage position to said deployed position by gravity.

8. The firearm support of claim 7, including a strap for securing said at least one leg to said sling when said at least one leg is in said storage position.

9. The firearm support of claim 2, wherein said at least one leg includes two of said pair of legs wherein each pair is splayed in said deployed position, thereby providing leg access of a shooter between said pairs of legs.

* * * * *